US008961377B1

(12) United States Patent
Simplis et al.

(10) Patent No.: US 8,961,377 B1
(45) Date of Patent: Feb. 24, 2015

(54) EXERCISE RESISTANCE APPARATUS

(76) Inventors: Olin Simplis, Los Angeles, CA (US); Malcolm S. Dinwiddie, Los Angeles, CA (US)

( * ) Notice: Subject to any disclaimer, the term of this patent is extended or adjusted under 35 U.S.C. 154(b) by 619 days.

(21) Appl. No.: 13/291,868

(22) Filed: Nov. 8, 2011

Related U.S. Application Data

(60) Provisional application No. 61/516,198, filed on Mar. 3, 2011.

(51) Int. Cl.
*A63B 21/02* (2006.01)

(52) U.S. Cl.
USPC ..... 482/124; 482/126

(58) Field of Classification Search
CPC .. A63B 21/02; A63B 21/055; A63B 21/0552; A63B 21/0557; A63B 21/1403; A63B 21/1423; A63B 21/1426; A63B 21/143; A63B 21/1434; A63B 21/1438; A63B 21/1442; A63B 23/047
USPC ..... 482/79, 92, 121–126
See application file for complete search history.

(56) References Cited

U.S. PATENT DOCUMENTS

| | | | | |
|---|---|---|---|---|
| 3,529,820 | A * | 9/1970 | Templeton | 482/122 |
| 4,852,874 | A * | 8/1989 | Sleichter et al. | 482/122 |
| 4,911,434 | A * | 3/1990 | Herring | 482/105 |
| 5,490,826 | A * | 2/1996 | Rose | 482/74 |
| 5,643,149 | A * | 7/1997 | Grimaldi et al. | 482/82 |
| 6,500,104 | B1 * | 12/2002 | Rich | 482/123 |
| 8,556,784 | B2 * | 10/2013 | Leibowitz | 482/124 |
| 2006/0160679 | A1 * | 7/2006 | Kung | 482/121 |
| 2008/0139369 | A1 * | 6/2008 | Vigilia | 482/124 |
| 2012/0322633 | A1 * | 12/2012 | Holman | 482/123 |
| 2013/0203567 | A1 * | 8/2013 | Thomas | 482/124 |

* cited by examiner

*Primary Examiner* — Oren Ginsberg

(57) ABSTRACT

An exercise apparatus (100) that comprises a tube (110) that has a first end (112) and a second end (113). The first end (112) has a first aperture (114), and the second end (113) has a second aperture (115). The first aperture (114) fluidly connects to the second aperture (115) via a channel (111). The exercise apparatus (100) further comprises an elastic assembly (140), that has a first end (141), a second end (142), and a middle component (143). The first end (141) is for attaching to a first appendage, and the second end (142) is for attaching to a second appendage. The middle component (143) passes through the channel (111) of the tube (110).

21 Claims, 4 Drawing Sheets

EXERCISE RESISTANCE APPARATUS

CROSS REFERENCE

This application claims priority to U.S. provisional application Ser. No. 61/516,198 filed Mar. 3, 2011, the specification of which is incorporated herein by reference in its entirety.

BACKGROUND OF THE INVENTION

The present invention is directed to an exercise resistance apparatus for use in exercising.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
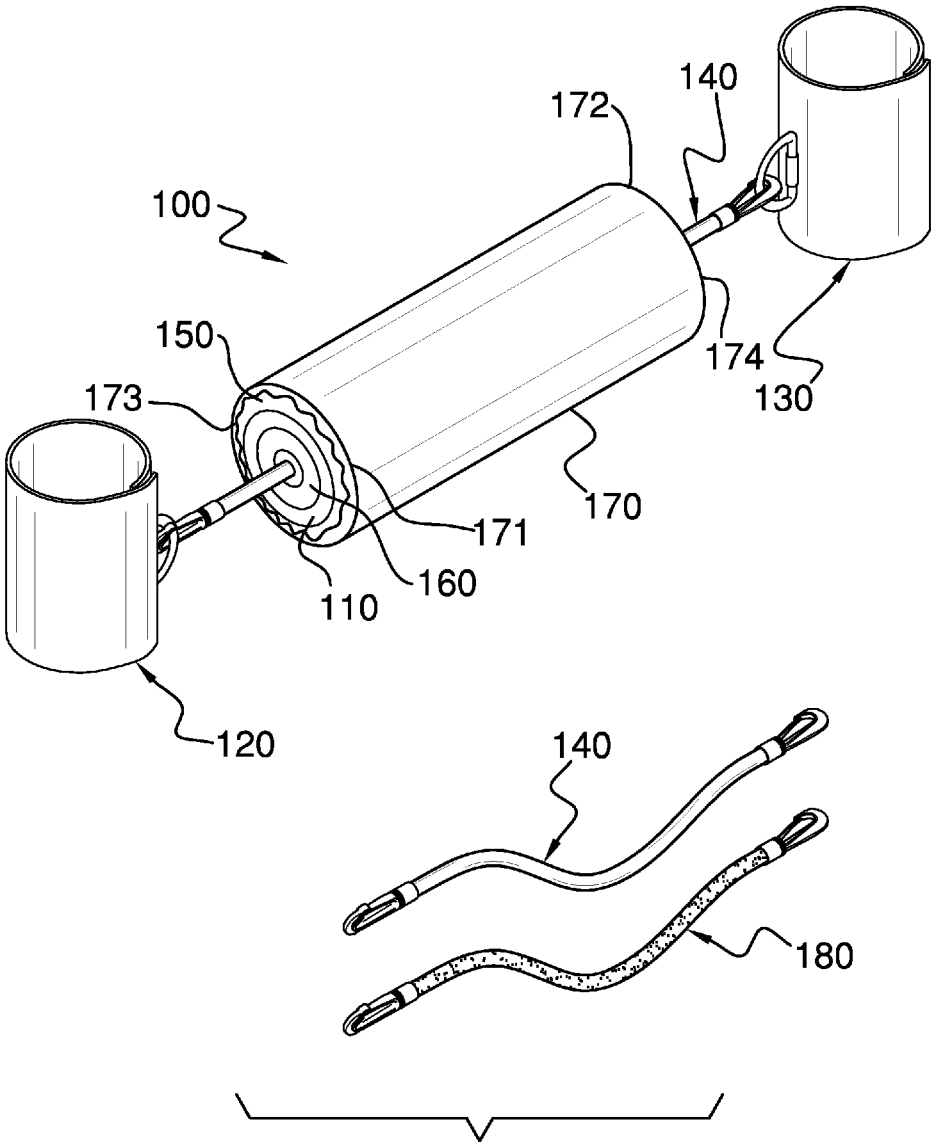
FIG. 1 shows an overall view of the apparatus.
Figure 2:
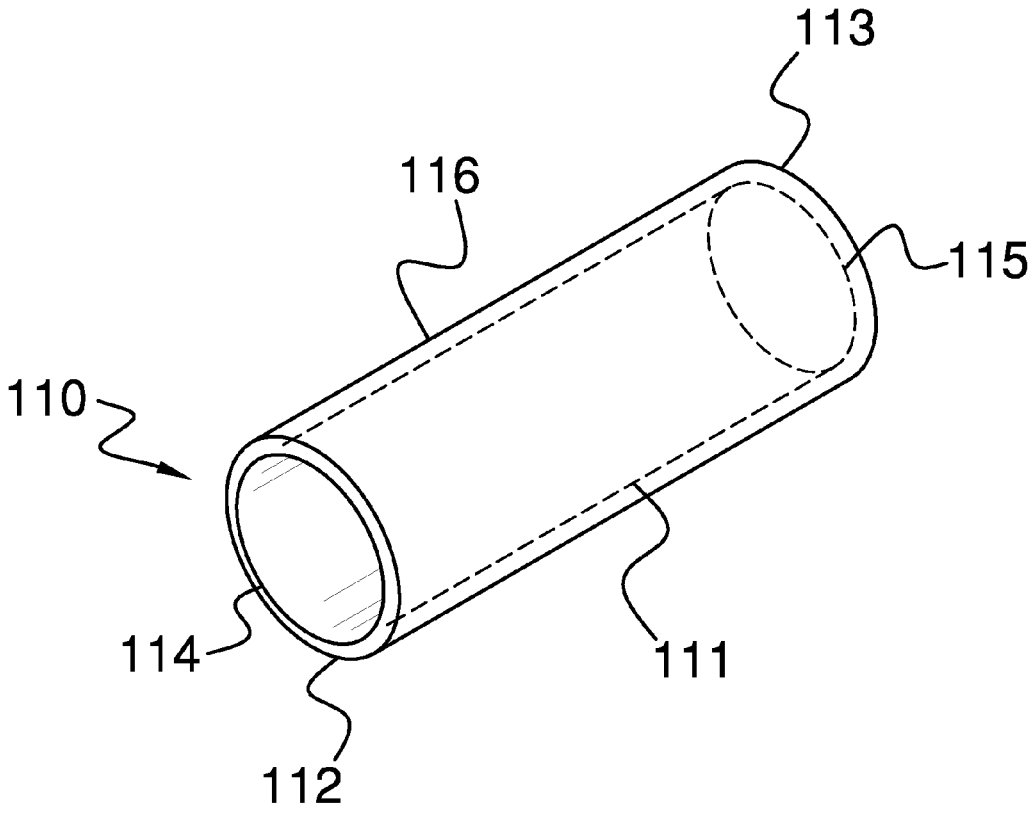
FIG. 2 shows a view of the tube.
Figure 3:
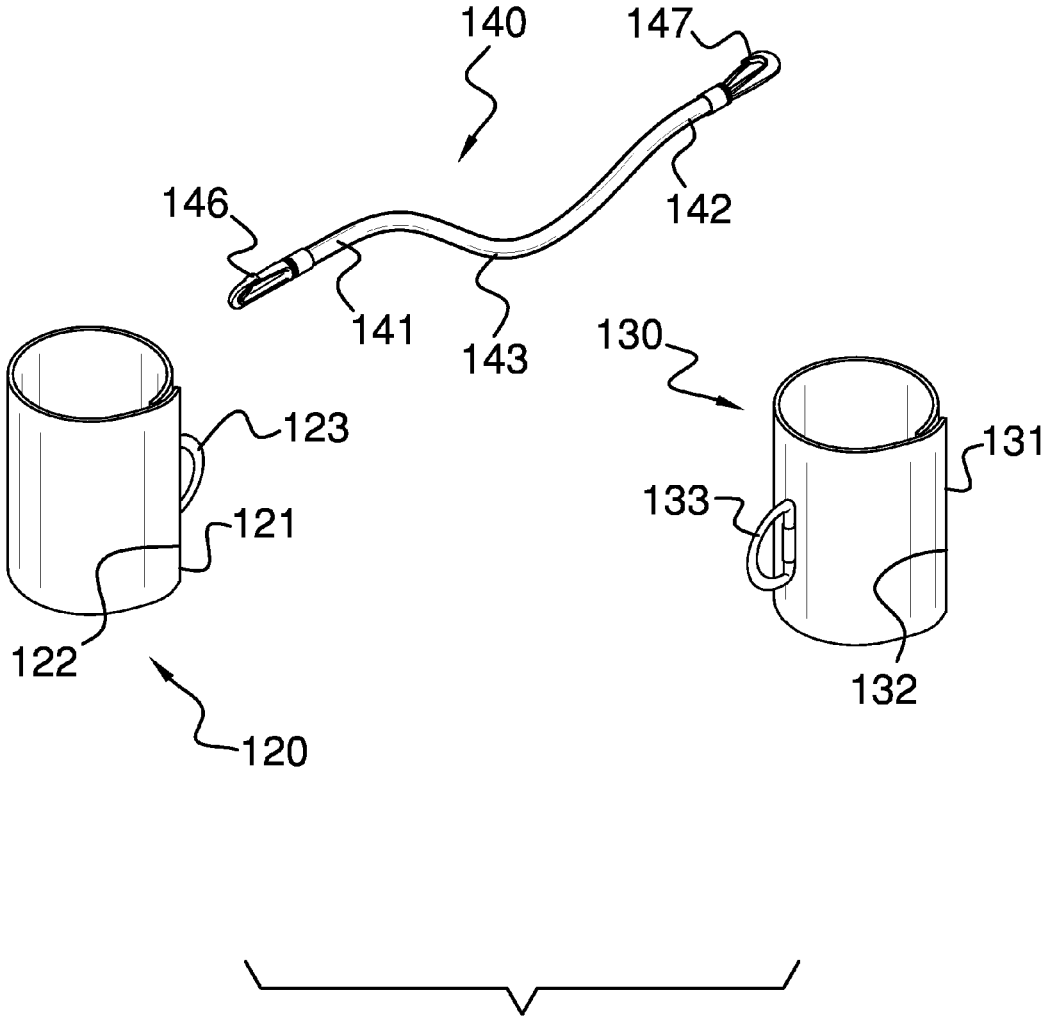
FIG. 3 shows a view of the first band, the second band and the elastic assembly.
Figure 4:
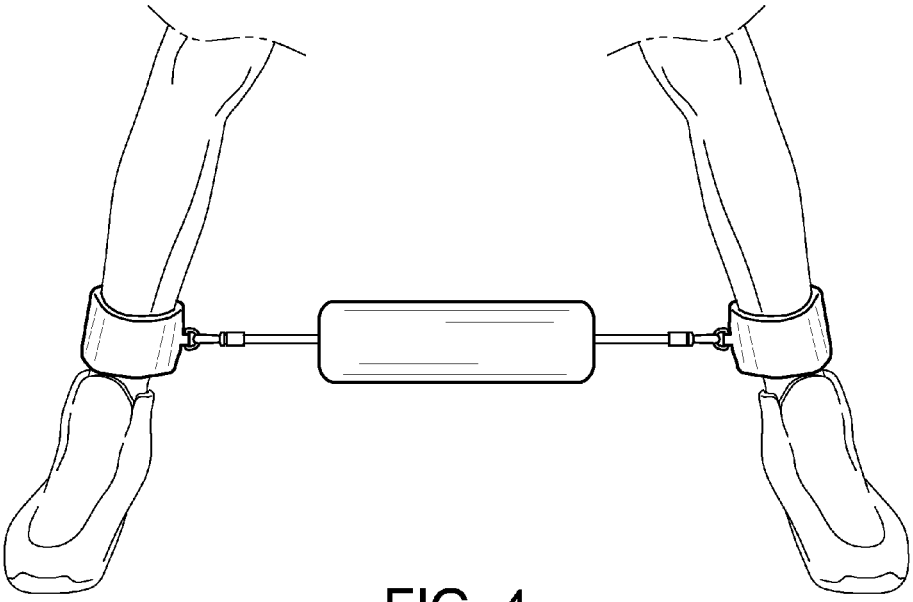
FIG. 4 shows the apparatus in an expanded position.
Figure 5:
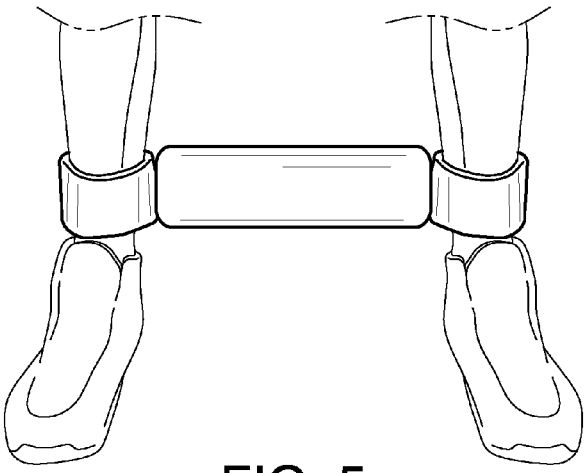
FIG. 5 shows the apparatus in a contracted position.

Referring now to FIG. 1-5, the present invention features an exercise apparatus (100). In some embodiments, the apparatus (100) comprises a tube (110) having a first end (112) and a second end (113). The first end (112) of the tube (110) has a first aperture (114), and the second end (113) of the tube (110) has a second aperture (115). The first aperture (114) fluidly connects to the second aperture (115) via a channel (111). A non-limiting example might be a piece of pipe or tubing that has an opening on an end that continues, uninhibited, throughout the length of the pipe.

In some embodiments, the apparatus (100) comprises an elastic assembly (140), having a first end (141), a second end (142), and a middle component (143). The first end is for attaching to a first appendage, and the second end (142) is for attaching to a second appendage. The middle component (143) of the elastic assembly (140) passes through the channel (111) of the tube (110). A non-limiting example might be a rubber band passing through a piece of pipe or tubing.

In some embodiments, the apparatus (100) comprises a tube (110) that is linear. A non-limiting example might be a piece of straight pipe or tubing.

In some embodiments, the apparatus (100) comprises a tube (110) that is constructed from a rigid material. A non-limiting example might be a piece of pipe or tubing constructed from a material such as metal or plastic.

In some embodiments, the apparatus (100) comprises a first aperture (114) that is sized to prevent the first end (141) of the elastic assembly (140) from passing through. It further comprises a second aperture (115) that is sized to prevent the second end (142) of the elastic assembly (140) from passing through. A non-limiting example might be a piece of pipe or tubing with an opening small enough to prevent the end of the elastic assembly (140) from being pulled into the opening.

In some embodiments, the apparatus (100) comprises an exterior surface (116) of the tube (110) that is at least partially covered by an exterior covering (150). A non-limiting example might be to use a piece of foam pipe insulation to cover the outside of the tube (110).

In some embodiments, the apparatus (100) comprises an exterior surface (116) of the tube (110) that is at least partially covered by an exterior covering (150) that is constructed of a soft material. A non-limiting example might be to use a piece of felt to cover the outside of the tube (110).

In some embodiments, the apparatus (100) comprises an exterior surface (116) of the tube (110) that is at least partially covered by an exterior covering (150) that is constructed of a spongy material. A non-limiting example might be to use a piece of foam to cover the outside of the tube (110).

In some embodiments, the apparatus (100) comprises a channel (111) of the tube (110) that is at least partially lined by an interior covering (160). A non-limiting example might be to use a piece of foam pipe insulation to cover the interior of the channel (111).

In some embodiments, the apparatus (100) comprises a channel (111) of the tube (110) that is at least partially lined by an interior covering (160) that is constructed of a soft material. A non-limiting example might be to use a piece of felt to cover the interior of the channel (111).

In some embodiments, the apparatus (100) comprises a channel (111) of the tube (110) that is at least partially lined by an interior covering (160), that is constructed of a spongy material. A non-limiting example might be to use a piece of foam to cover the interior of the channel (111).

In some embodiments, the apparatus (100) comprises a tube (110) that is encased in a sleeve (170), that has a first end (171), and a second end (172). A non-limiting example might be a rectangular piece of cloth that has two opposite edges sewn together resulting in a cylindrically shaped sleeve (170) that would cover the tube (110).

In some embodiments, the apparatus (100) comprises a tube (110) that is encased in a sleeve (170), that has a first end (171), and a second end (172). The first end (171) comprises a first opening (173) that is sized so that the tube (110) may pass through, with a means to cinch the first opening (173). The second end (172) comprises a second opening (174) that is sized so that the tube (110) may pass through, with a means to cinch the second opening (174). A non-limiting example might be a sleeve (170) that is open on both ends, with a piece of elastic sewn along the edge of each open end. With the elastic in a contracted state, the elastic would cinch an open end, reducing the size of the opening. With the elastic in an expanded state, the open end would be stretched to its original size.

In some embodiments, the apparatus (100) comprises a tube (110) that is encased in a sleeve (170), that is constructed from a flexible material. A non-limiting example might be that the sleeve (170) is constructed from cloth, nylon or canvas.

In some embodiments, the apparatus (100) comprises a tube (110) that is encased in a sleeve (170), that is constructed from a durable material. A non-limiting example might be that the sleeve (170) is constructed from plastic.

In some embodiments, the apparatus (100) comprises a first end (141) comprising a first band (120), and a second end (142) comprising a second band (130). A non-limiting example might be that the first band (120) and the second band (130) fit around the appendage, like a terry cloth wrist band.

In some embodiments, the apparatus (100) comprises a first end (141) comprising a first band (120), and a second end (130) comprising a second band (130). The first band (120) is constructed from a flexible material and the second band (130) is constructed from a flexible material. A non-limiting example might be that the first band (120) and the second band (130) are comprised of a piece of cloth sewn into the shape of a cylinder.

In some embodiments, the apparatus (100) comprises a first end (141) comprising a first band (120), and a second end (130) comprising a second band (130), The first band (120) is constructed from an elastic material, and the second band (130) is constructed of a elastic material. A non-limiting example might be an elastic wrist band or elastic ankle band.

In some embodiments, the apparatus (100) comprises a first end (141) comprising a first band (120), and a second end (130) comprising a second band (130). The first band (120) is non-continuous, having a first end (121) and a second end (122). The first end (121) of the first band (120) attaches to the second end (122) of the first band (120) via a hook and loop system. The first end (131) of the second band (130) attaches to the second end (132) of the second band (130) via a hook and loop system. A non-limiting example might be a flat band that wraps fully around the appendage and is secured to itself by a hook and loop system.

In some embodiments, the apparatus (100) comprises a first end (141) comprising a first band (120), and a second end (130) comprising a second band (130). The first band (120) is non-continuous, having a first end (121) and a second end (122). The first end (121) of the first band (120) attaches to the second end (122) of the first band (120) via a strap and buckle system. The first end (131) of the second band (130) attaches to the second end (132) of the second band (130) via a strap and buckle system. A non-limiting example might be a flat band that wraps around the appendage and is secured to itself by a strap and buckle system.

In some embodiments, the apparatus (100) comprises a first end (141) comprising a first band (120), and a second end (142) comprising a second band (130). The first band (120) comprises a first ring (144) disposed thereon for attaching the first end (141) to the first band (120). The second band (130) comprises a second ring (145) disposed thereon for attaching the second end (142) to the second band (130). A non-limiting example might be a D-ring secured to the band via a cloth strap sewn overlapping the top of the D-ring.

In some embodiments, the apparatus (100) comprises a first end (141) comprising a first hook (146) disposed thereon and a second end (130) comprising a second hook (147) disposed thereon. The first hook (146) is used to attach the first end (141) to the first band (120). The second hook (147) is used to attach the second end (142) to the second band (130). A non-limiting example might be an elastic cord with a hook securely attached to each end. The hook on each end would be used to attach to the band.

In some embodiments, the apparatus (100) comprises an elastic assembly (140) that is interchangeable with a second elastic assembly (180). The second elastic assembly (180) has a different degree of resistance. A non-limiting example might be an interchangeable elastic assembly with a predetermined resistance factor. An alternative interchangeable elastic assembly might have a greater or a lesser predetermined resistance factor, thereby providing added versatility to the apparatus.

In some embodiments, the apparatus (100) comprises an elastic assembly (140) that comprises an elastic cord. A non-limiting example might be an elastic nylon cargo strap with hooks attached to each end.

In some embodiments, the apparatus (100) comprises an elastic assembly (140) that comprises a spring. A non-limiting example might be a spring with hooks formed on each end.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An exercise apparatus (100) comprising:

a) a tube (110) having a first end (112) and a second end (113), the first end (112) having a first aperture (114), the second end (113) having a second aperture (115), the first aperture (114) fluidly connecting the second aperture (115) via a channel (111), wherein an exterior surface (116) of the tube (110) is at least partially covered by an exterior covering (150), wherein the channel (111) of the tube (110) is at least partially lined by an interior covering (160), wherein the tube (110) is encased in a sleeve (170), said sleeve (170) having a first end (171), and a second end (172), said first end (171) comprising a first opening (173) sized so that the tube (110) may pass through, and a means to cinch the first opening (173), said second end (172) comprising a second opening (174) sized so that the tube (110) may pass through and a means to cinch the second opening (174);

b) an elastic assembly (140), having a first end (141), a second end (142), and a middle component (143), said first end (141) is for attaching to a first appendage, said second end (142) is for attaching to a second appendage, said middle component (143) passes through the channel (111) of the tube (110).

2. The apparatus (100) of claim 1, wherein the tube (110) is linear.

3. The apparatus (100) of claim 1, wherein the tube (110) is constructed from a rigid material.

4. The apparatus (100) of claim 1, wherein said first aperture (114) is sized to prevent the first end (141) of the elastic assembly (140) from passing through, said second aperture (115) is sized to prevent the second end (142) of the elastic assembly (140) from passing through.

5. The apparatus (100) of claim 1, wherein said exterior covering (150) is constructed from a soft material.

6. The apparatus (100) of claim 1, wherein said exterior covering (150) is constructed from a spongy material.

7. The apparatus (100) of claim 1, wherein said interior covering (160) is constructed from a soft material.

8. The apparatus (100) of claim 1, wherein said interior covering (160) is constructed from a spongy material.

9. The apparatus (100) of claim 1, wherein said sleeve (170) is constructed from a flexible material.

10. The apparatus (100) of claim 1, wherein said sleeve (170) is constructed from a durable material.

11. The apparatus (100) of claim 1, wherein said first end (141) comprising a first band (120), said second end (142) comprising a second band (130).

12. The apparatus (100) of claim 1, wherein said first end (141) comprising a first band (120), said second end (142) comprising a second band (130), said first band (120) is constructed from a flexible material, said second band (130) is constructed from a flexible material.

13. The apparatus (100) of claim 1, wherein said first end (141) comprising a first band (120), said second end (142) comprising a second band (130), said first band (120) is constructed from an elastic material, said second band (130) is constructed from an elastic material.

14. The apparatus (100) of claim 1, wherein said first end (141) comprising a first band (120), said second end (142) comprising a second band (130), said first band (120) is non-continuous, having a first end (121) and a second end (122), wherein the first end (121) of the first band (120) attaches to the second end (122) of the first band (120) via a hook and loop system, wherein a first end (131) of the second band (130) attaches to a second end (132) of the second band (130) via a hook and loop system.

15. The apparatus (100) of claim 1, wherein said first end (141) comprising a first band (120), said second end (142) comprising a second band (130), said first band (120) is non-continuous, having a first end (121) and a second end (122), wherein the first end (121) of the first band (120) attaches to the second end (122) of the first band (120) via a strap and buckle system, wherein a first end (131) of the second band (130) attaches to a second end (132) of the second band (130) via a strap and buckle system.

16. The apparatus (100) of claim 1, wherein said first end (141) comprising a first band (120), said second end (142) comprising a second band (130), said first band (120) comprising a first ring (123) disposed thereon for attaching the first end (141) to the first band (120), said second band (130) comprising a second ring (133) disposed thereon for attaching the second end (142) to the second band (130).

17. The apparatus (100) of claim 1, wherein said first end (141) comprising a first hook (146) disposed thereon, said second end (142) comprising a second hook (147) disposed thereon, said first hook (146) used to attach the first end (141) to a first band (120), said second hook (147) used to attach the second end (142) to a second band (130).

18. The apparatus (100) of claim 1, wherein the elastic assembly (140) is interchangeable with a second elastic assembly (180), said second elastic assembly (180) having a different degree of resistance.

19. The apparatus (100) of claim 1, wherein the elastic assembly (140) comprises an elastic cord.

20. The apparatus (100) of claim 1, wherein the elastic assembly (140) comprises a spring.

21. An exercise apparatus (100) consisting of:

a) a tube (110) having a first end (112) and a second end (113), the first end (112) having a first aperture (114), the second end (113) having a second aperture (115), the first aperture (114) fluidly connecting the second aperture (115) via a channel (111), wherein an exterior surface (116) of the tube (110) is at least partially covered by an exterior covering (150), wherein the channel (111) of the tube (110) is at least partially lined by an interior covering (160), wherein the tube (110) is encased in a sleeve (170), said sleeve (170) having a first end (171), and a second end (172), said first end (171) consisting of a first opening (173) sized so that the tube (110) may pass through, and a means to cinch the first opening (173), said second end (172) consisting of a second opening (174) sized so that the tube (110) may pass through and a means to cinch the second opening (174);

b) an elastic assembly (140), having a first end (141), a second end (142), and a middle component (143), said first end (141) is for attaching to a first appendage, said second end (142) is for attaching to a second appendage, said middle component (143) passes through the channel (111) of the tube (110).

* * * * *